United States Patent [19]

Meheen et al.

[11] 4,050,254

[45] Sept. 27, 1977

[54] MODULAR STRUCTURES, RETAINING WALL SYSTEM, AND METHOD OF CONSTRUCTION

[75] Inventors: Homayoun J. Meheen, Golden; Farrel D. Nielson, Castle Rock, both of Colo.

[73] Assignee: International Engineering Company, Inc., Denver, Colo. ; by said Farrel D. Nielson

[21] Appl. No.: 604,437

[22] Filed: Aug. 13, 1975

[51] Int. Cl.[2] ..... E02D 5/00

[52] U.S. Cl. ..... 61/39; 61/35

[58] Field of Search ..... 61/35, 39, 49; 52/396, 52/610

[56] References Cited

U.S. PATENT DOCUMENTS

| | | | |
|---|---|---|---|
| 2,210,218 | 8/1940 | Ramsey | 61/35 |
| 2,566,748 | 9/1951 | Ringrose | 61/39 X |
| 3,888,599 | 6/1975 | Reifsnyder | 52/396 X |

FOREIGN PATENT DOCUMENTS

| | | | |
|---|---|---|---|
| 241,911 | 12/1962 | Australia | 61/39 |
| 694,233 | 9/1965 | Italy | 61/49 |
| 240,017 | 9/1925 | United Kingdom | 61/39 |

*Primary Examiner*—Paul R. Gilliam
*Assistant Examiner*—David H. Corbin
*Attorney, Agent, or Firm*—Shanley, O'Neil and Baker

[57] ABSTRACT

A modular assembled retaining wall is constructed by founding a plurality of precast tie-back elements in laterally spaced relationship along a grade line. The tie-back elements include upright column means against which retaining panel means are arranged to span the lateral space between pairs of tie-back elements. Horizontal leg means of the tie-back elements project a substantial distance from the base of the column means so as to transmit soil fill pressure on the retaining panel means back into the overburden and earth's mass. The shape and length of the horizontally oriented leg means are designed to maximize friction to resist pull-out of the tie-back elements. No mechanical interconnection is utilized between the modular elements or successive modular assembled tiers. Surcharge is compacted in sequential stages during or after the completion of each tier. Each tier is spaced inwardly toward the embankment with relation to the next lower tier and the tiers overlap in elevation. The tie-back elements in contiguous tiers can be staggered laterally.

13 Claims, 11 Drawing Figures

FIG. 1
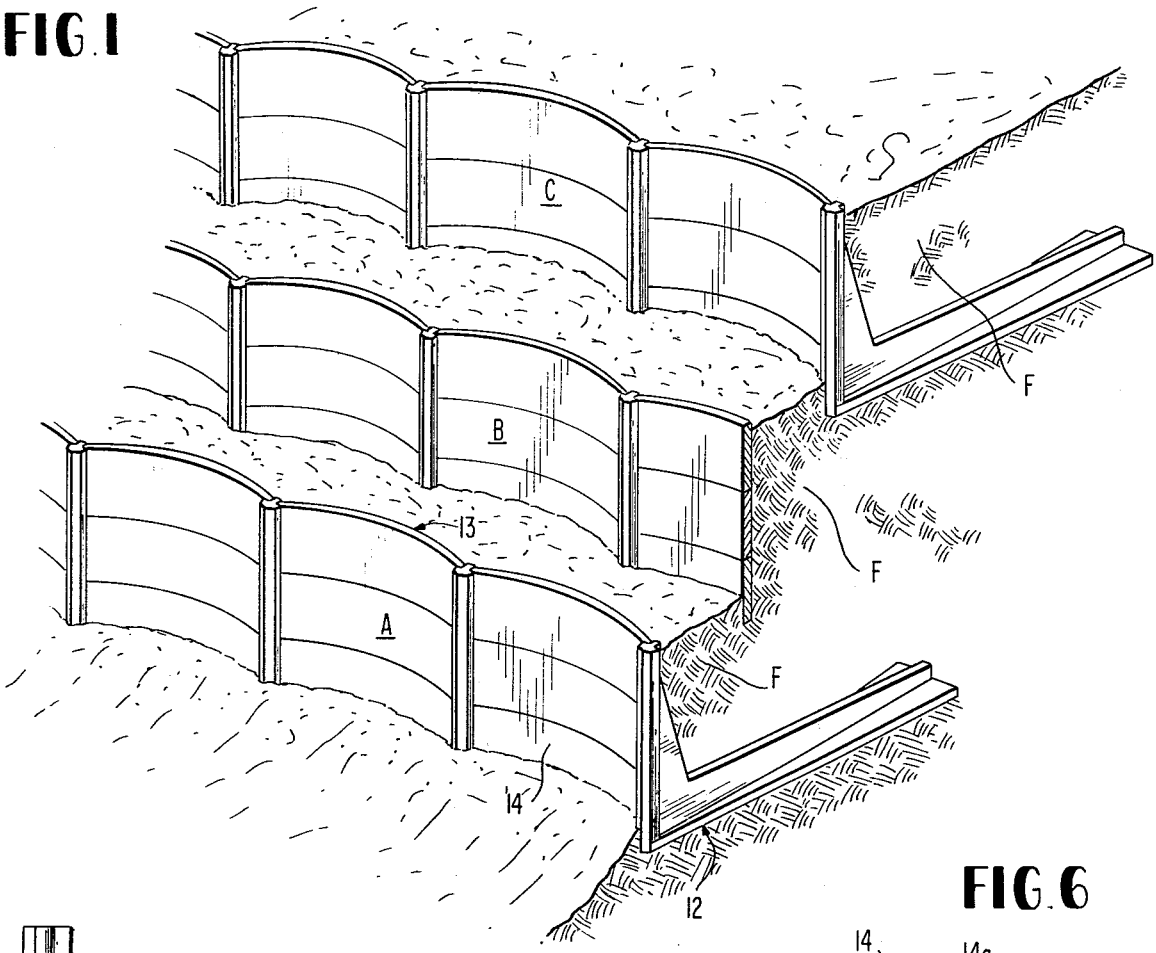
FIG. 6
FIG. 4
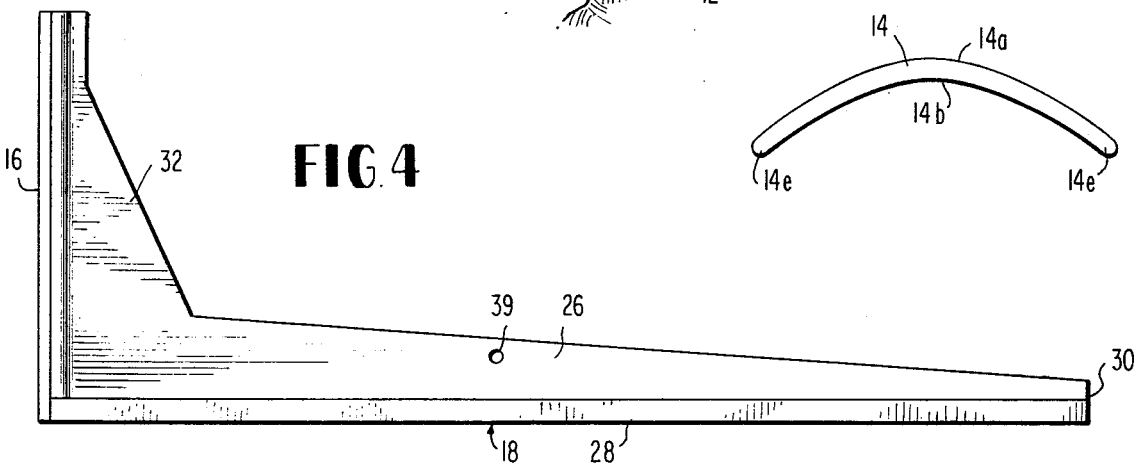
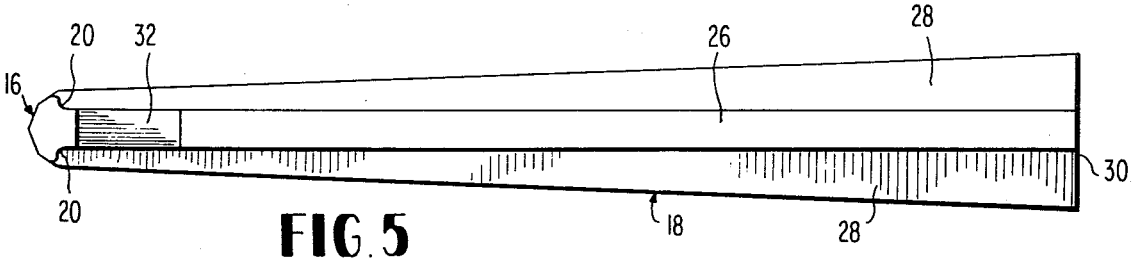
FIG. 5

FIG. 9
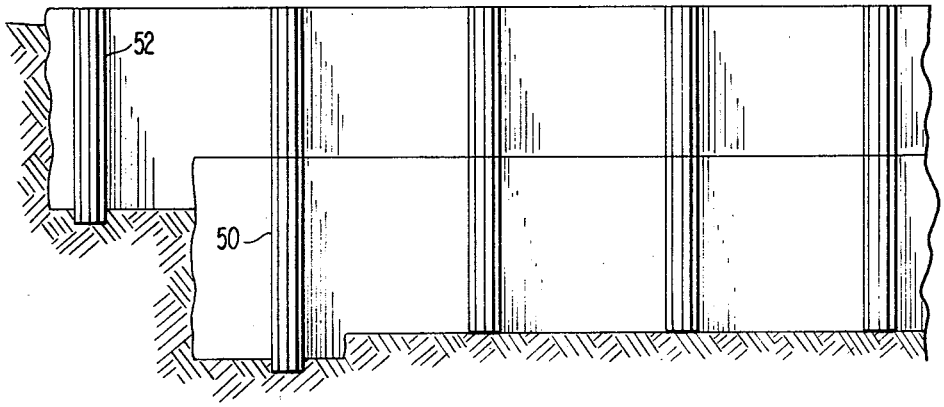
FIG. 10
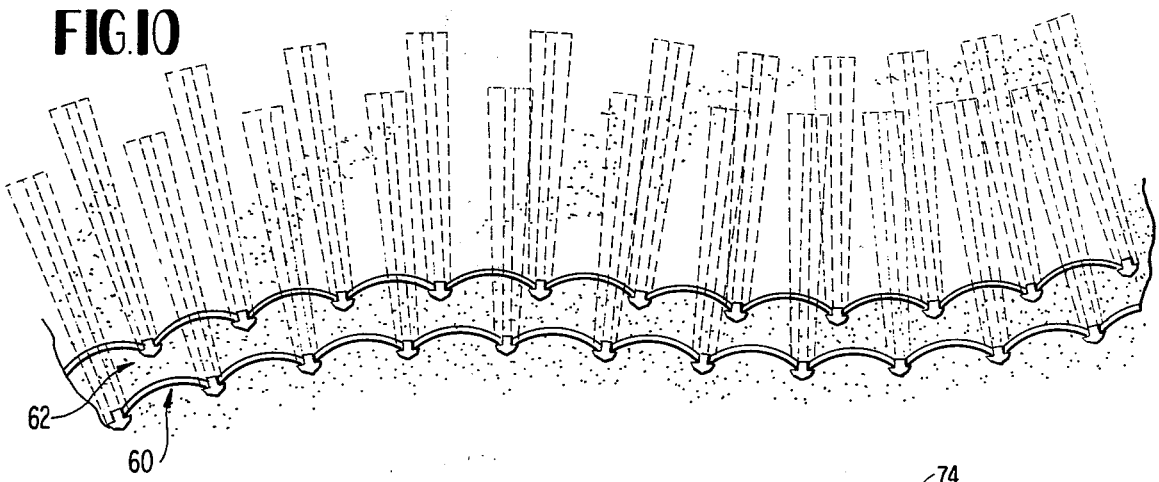
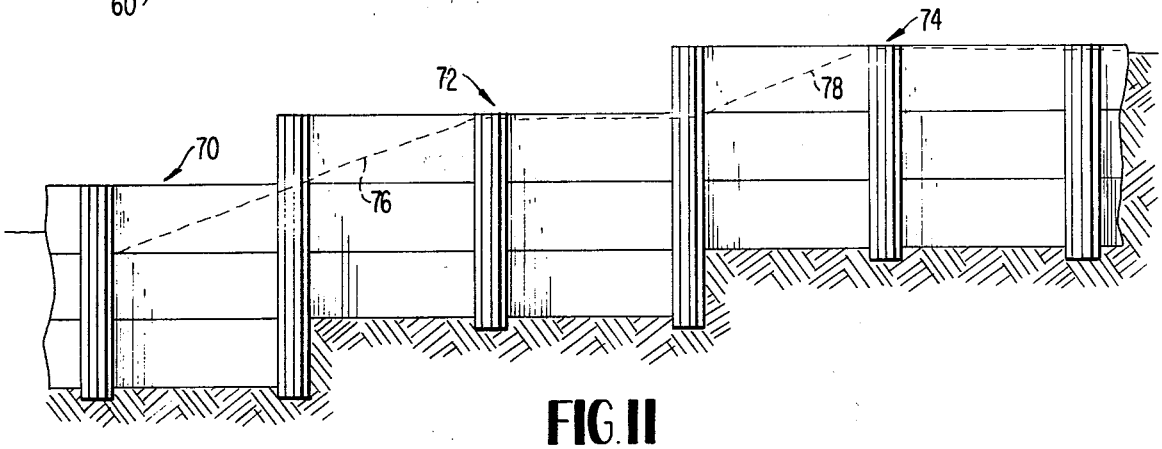
FIG. 11

MODULAR STRUCTURES, RETAINING WALL SYSTEM, AND METHOD OF CONSTRUCTION

The present invention relates to retaining wall modular components and modular construction of embankment retention walls for controlling terrain.

Differing methods have been utilized in the past for constructing retaining walls including use of standardized modules. U.S. Pat. No. 3,282,054 utilizes a plurality of standardized block units which are assembled one on top of the other to a desired elevation without the use of mortar. In such a system, the entire retaining wall utilizes the same basic foundation since each of the blocks of the entire wall rests on and is dependent upon, the blocks immediately below. This has a limiting effect on versatility and application of such a system. One practical difficulty is compacting soil fill.

Other prior systems require interconnection of elements or timed assembly which limit versatility.

The present invention provides structural components and a novel method for erecting and retaining embankments of soil utilizing a modular principle which eliminates the above drawbacks of the prior art. The retaining wall and method of construction of the invention may be used to retain low to high fills of steep slope, e.g., for control of mountain terrain adjacent to the shoulder of a road, with maximum safety, speed of erection, and overall economy while, at the same time, permitting certain asthetic effects to be achieved, if desired.

The present invention provides a retaining wall and method which utilize modular structural units, such as precast strengthened concrete units, which may be mass produced away from the construction site, stored as desired, and then easily erected with a minimum of skill and supervision. More specifically, a novel "tie-back" component is provided for placement and support of soil retaining panels and for transmitting soil pressures on such panels back into the soil mass while resisting pull-out or other unwanted movement of the wall. The result is a retaining wall possessing high strength, stability, and durability.

In the retaining wall system of the present invention, a plurality of retaining wall tiers can be erected independently of each other to a desired elevation in a continuous sequential fashion or at desired intervals.

Objectives of the invention are achieved by utilizing a plurality of tie-back elements comprising integral wall forming and wall retaining structure. These stress supporting and transmitting components are placed on a suitable foundation above which an embankment is to be constructed utilizing soil fill to another grade level. Retaining panel means span the lateral space between adjacent pairs of such tie-back elements without any positive interconnection between these module structures. Each of the tie-back elements include vertically oriented column means in angled relationship to horizontally oriented leg means.

In a preferred embodiment, such column means include recesses for receiving ends of retaining panels and an expansion joint or elastomeric material can be placed in the column recesses to engage the ends of the retaining panels. The soil retaining panel means are preferably formed with a concavo-convex configuration in horizontal cross section and are placed against the columns of the tie-back elements with the convex sides constituting the inner surface of the wall for retaining the soil fill.

The horizontally oriented leg means of the tie-back elements project into the embankment a substantial distance from the base of the column means so as to transmit pressure from the retaining panels back into the earth's mass. The height of the column portions of the tie-back elements can vary depending on the particular embankment to be constructed. The length of the horizontal leg portion and ratio of the length of the horizontal leg portion to length of the column means is largely a function of soil stability conditions.

The horizontal leg portions are also designed with a shape to maximize the friction between the soil fill earth mass and the tie-back elements so as to effectively resist pull-out or outward tilting of a tie-back element in a completed wall. For example, the horizontal leg means can be formed with flanges of a greater width dimension adjacent the free extremity of the leg means than the width dimension contiguous to the column portion of the tie-back element. In a preferred embodiment, this is effected by forming the horizontal flange portion of the leg means with converging or tapering sides in approaching the column means of the tie-back element.

Reinforcing web means form part of the unitary structure tie-back elements and extend between the column and leg means along the interior angle formed by such portions of the tie-back elements.

Other features and advantages of the present invention will be brought out in the following more detailed description of a specific embodiment made in conjunction with the accompanying drawings. In these drawings:

FIG. 1 is a perspective view, with portions cut away, of a multi-tier embankment embodying the invention;

FIG. 4 is a side-elevational view of a tie-back element of the present invention;

FIG. 5 is a plan view of the tie-back element of FIG. 4;

FIG. 6 is a plan view of retaining panel means of the present invention;

FIG. 9 is a view in elevation, partially cut away, of another arrangement embodying the invention;

FIG. 10 is a plan view, with selected sub surface portions shown in dotted lines, embodying the invention; and FIG. 11 is a view in elevation, with portions cut away, of another arrangement embodying the invention.

In FIG. 1, retaining wall structure for an embankment constructed in accordance with the invention includes tiers A, B and C which retain soil fill F at different grade elevations. Such an embankment may exist, for example, on either shoulder of road, i.e., below road level to support the road or above road level to maintain a protective slope. Each of the retaining walls of tiers A, B and C are constructed from modular components consisting essentially of two basic parts; one being a tie-back means 12 and the other being soil retaining means 13. The soil retaining means 13 can be made in one piece or can include a plurality of individual elongated panels 14 as shown in FIG. 1. Use of a plurality of individual elongated panels increases the flexibility in assembly and use.

Figure 8:
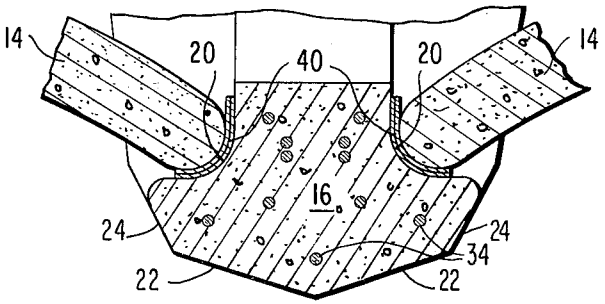
FIG. 8 is a fragmental cross-sectional view, to an enlarged scale, of a portion of a tie-back element taken generally along lines 8—8 of FIG. 3.
Figure 7:
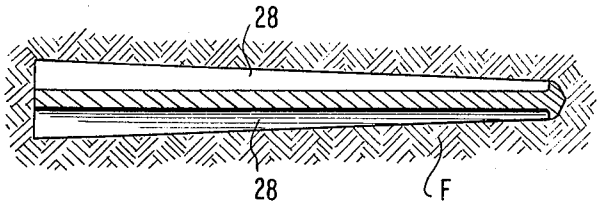
FIG. 7 is a fragmental, cross-sectional view of a portion of a tie-back element taken along lines 7—7 of FIG. 2.

Referring to FIGS. 4, 5 and 8, tie-back element 12 includes a vertically-oriented column means 16 and a horizontally oriented leg means 18, the latter is unitary with the base of column means 16 and projects at an angle of substantially 90° to form an L-shaped configuration in side elevation. The overall length of leg means 18 is preferably at least equal to the height of the column means 16. In one specific example of the invention, the height of column means 16 is approximately 10 feet and the overall length of leg means 18 is approximately 28 feet.

Such dimensions may vary depending upon the slope of the terrain or the embankment to be constructed as well as the type of material being used, e.g., whether granular, cohesive, well-draining, etc., and degree of compaction of the fill F during construction. Also, the tie-back element dimensions in different tiers may vary depending upon the terrain and specific objectives to be achieved in constructing the embankment.

Referring to FIGS. 5 and 8, column means 16 of the tie-back elements includes a pair of elongated recesses 20 extending along opposite sides of the column for receiving the longitudinal opposite sides of the column for receiving the longitudinal opposite ends of panels 14 during assembly. In a preferred embodiment, the front face of column 16 of tie-back element 12 is relieved, in the general form of a crescent, as shown in FIG. 8. In the specific embodiment illustrated, this is effected at the bevel surface 22 and 24 which extend at obtuse angles relative to each other. The transverse cross-sectional configuration of column means 16 is selected to provide adequate strength for reception of force applied through the retaining panels and to provide compactness, ease of manufacture, and to reduce likelihood of fracture during handling.

In the embodiment shown in FIGS. 1 and 5, leg means 18 has an inverted generally T-shaped cross section. This configuration is formed by an elongated central web 26, of rectangular cross section, and a pair of horizontal flanges 28 projecting from opposite sides to web 26. As noted above, the length of leg means 18 is designed so that when the tie-back is installed during construction there will be sufficient frictional resistance to prevent "pull-out" or dislodgment of the tie-back element by virtue of retained soil. This frictional resistance is enhanced by the surface area of the leg means 18 provided by such inverted T-shaped cross section. It is additionally enhanced by designing portions of the leg means 18 adjacent its free extremity 30 with a greater transverse or width dimension than the portions contiguous to upright column means 16. For example, as shown, flanges 28 are formed with their opposite sides converging, from a widest portion at the free extremity 30 toward the opposite end adjacent column means 16. In the specific embodiment where the overall length of the leg means 18 is 28 feet, the taper is such that at the free extremity 30, the width is about 4 feet and, at the opposite end adjacent column means 16, the width is approximately 2 feet. Also in this embodiment, the width of the central web 26 is approximately 10 inches. This configuration resists tilting as well as pull-out of the tie-back element.

Unitary web means for the tie-back element extend between the column means 16 and the leg means 18; such web means include web 26 located centrally of leg means 18 and upright web 32. Another important function of such vertically oriented web reinforcing means is the provision of resistance to lateral movement of the tie-back elements which would tend to separate cooperating pairs of tie-back elements. With the vertical orientation and relatively large planar area of such web reinforcing means surcharge compaction helps prevent lateral displacement.

The column means, leg means and reinforcing web means of a tie-back element 12 can be constructed as a unitary precast concrete structure with steel reinforcement means in flange 28 in column means 16; steel reinforcing rod 34 is column 16 of FIG. 8 are a typical example. Reinforcing rod means are also used in the web means 26 and 32. Precast concrete structures can also be strengthened by prestressing, post-tensioning, or other means known in the art.

In order to facilitate handling of tie-back elements 12 during transfer and particularly during assembly at the construction site, the central web 26 is provided with a transverse aperture 39 to receive handling equipment such as cables. Such handling aperture can be located contiguous to the center of gravity of a tie-back element. Other handling apertures or hook means can be located about the tie-back element. To control orientation during handling, hook means can be located at the top of the column means and along the leg means.

Retaining means 13 of FIG. 1 comprise three individual elongated panels 14 arranged one above the other to the desired height. Such individual panels facilitate mechanized compaction as the retaining panel wall is being built up. These panels are also formed as precast strengthened concrete structures. The panels have a concavo-convex cross section, i.e., circular or parabolic arch, in horizontal plan view so as to resist the load from the compacted soil fill F in compression. When panel 14 of FIG. 6 is installed as shown in FIG. 1, convex side **14*a* of the panel faces inwardly toward the embankment and receives the compacted soil fill F while the opposite, concave side 14*b* faces outwardly and is exposed. Panels 14 span the lateral space between cooperating pairs of tie-back elements with their opposite ends 14*e* received in recesses 20 of the tie-back column means 16 as shown in FIG. 8.**

In building a wall between adjacent tie-back elements, panels 14 are stacked one on top of the other with no positive fasteners or connecting means being utilized between panels 14 and tie-back elements 12. However, an expansion joint material can be provided as a cushion between the panel ends **14*e* and the contact surface portions of the tie-back elements. This expansion joint material in a specific embodiment comprises elongated strips 40 formed from asphalt impregnated felt material. It will further be noted that in the specific embodiment the opposite ends 14*e* of panels 14 are rounded to avoid sharp corners that may be subject to fracture and also to conform in configuration to the concave recesses 20** in order to facilitate reception and holding of the panel means by the column means.

In the specific concavo-convex example described above, each individual panel 14 has a vertical height of approximately 3 feet, a thickness of approximately 6 to 8 inches, and a straight line (chord) dimension between opposite ends **14*e*** of approximately 9 feet.

Figure 2:
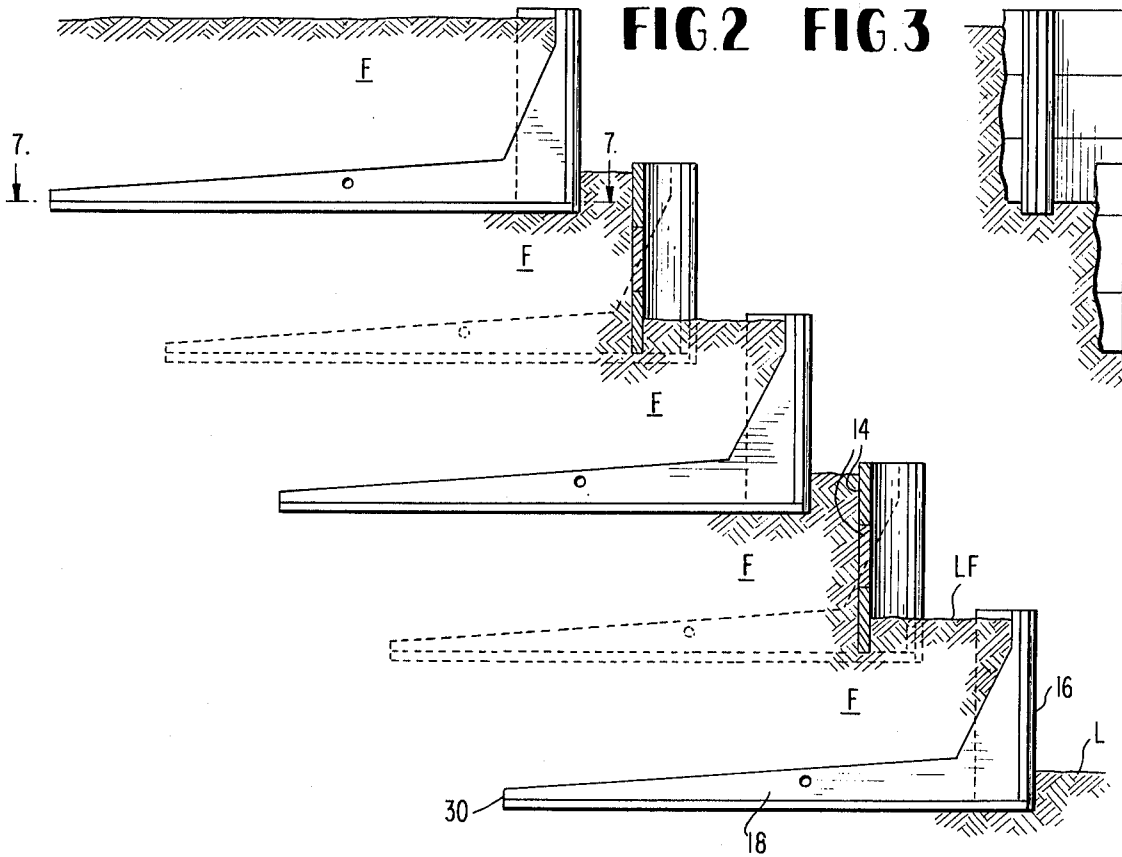
FIG. 2 is a cross-sectional view of the embankment of FIG. 1 as seen in side view with added tiers of individual retaining walls.

In constructing an embankment with a retaining wall system including a plurality of tiers such as A, B and C as shown in FIG. 1, the lower tier is first constructed by initially placing the tie-backs 12 at approximately 10 foot centers on a suitable foundation approximately 2 feet below the grade level L as indicated in FIG. 2. Tie-back elements 12 are placed with column portions 16 extending substantially vertically upright with leg portions 18 extending substantially horizontally. While the column means 16 may be angled toward the embankment, it would not ordinarily be angled oppositely where normal soil retaining functions are being performed.

After tie-backs 12 are properly positioned in laterally spaced relationship transverse to a central axis extending into the embankment, individual panels 14 are stacked one on top of the other sequentially. Opposite ends 14e of such panels are received in the elongated recesses 20 of the column portions 16 of the tie-back elements 12. As placement of the panels proceeds, soil fill F is introduced behind panels 14 and on top of the horizontally oriented leg portions 18 and firmly compacted against panels 14 and on top of the leg portions 18. When placing fill around tie-back elements at the end of a tier, where insufficient end abutment exists, it is preferable to hold the tie-backs together to prevent spreading as the fill is being placed. This may be effected, for example, by cables attached in apertures 39 and the like. Depending on local conditions at the construction site, any suitable drainage means (not shown) may be incorporated if desired in the soil fill F to ensure proper drainage. Although it should be noted that because of the offset tier construction of the present invention, the retaining wall system will be free of large hydrostatic pressures.

Figure 3:
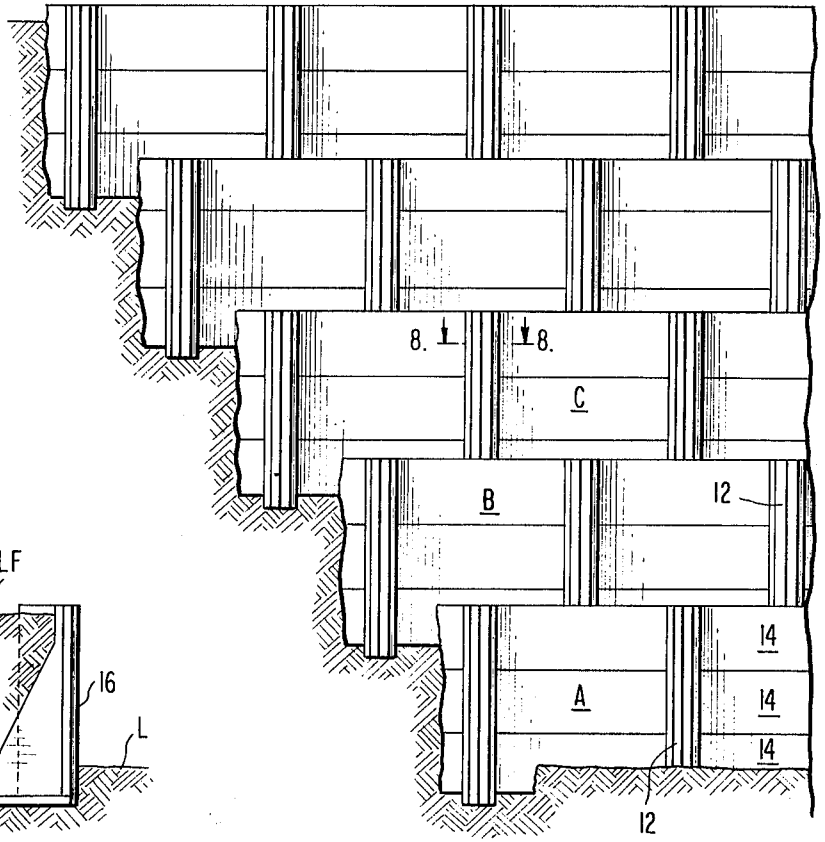
FIG. 3 is a fragmental front elevation view, with portions cut away, of the embankment and retaining structure of FIG. 2.

After the lower level tier A is constructed, the second tier B is constructed above tier A using the same assembly method. The locations of the tie-back elements 12 in the second tier can be staggered with respect to the locations of the tie-back element in the first tier as illustrated in FIG. 3; i.e., each next successive tier being assembled with its tie-back elements being positioned intermediate the positions of the tie-back elements in the next lower tier. This provides suitable planting areas, breaks up vertical lines and shadows, and, in general, provides a more aesthetically acceptable appearance.

Also, it will be noted from FIG. 2, that the lowermost portions of the tie-backs in the second tier B are installed below, for example approximately 2 feet, the upper level LF of the compacted soil fill bearing on the first tier. This overlap dimension can vary depending on the slope of the embankment desired and also upon the degree of compaction of the soil fill F. Furthermore, the upper tier is displaced rearwardly into the embankment which adds to soil fill above the lower tier. This displacement in the direction of the embankment may also be varied depending on the slope of embankment to be achieved and the degree of compaction of the soil fill F.

Subsequent tiers, erected in the same manner, can be erected immediately after the lower tiers are erected or at later times since each of the tiers are self-sustaining and do not require the support of the tiers above. While in the specific embodiment disclosed, the tie-back elements 12 in each of the tiers have horizontal leg portions 18 of the same length, in certain installations, the length of these leg portions in upper tiers may be made less than the length of those in the lower tiers. Also the interior angle between the column means and leg means of a tie-back element can be slightly less than 90° but not so as to interfere with compaction or the type of offset construction taught.

Panels 14 are retained in place against tie-back elements by means of the pressure of the soil fill F behind the panels. The concavo-convex curvature of the panels 14 and their placement with the convex surface facing inwardly to receive the soil fill, permit the panels to absorb the soil fill loads largely in compression. Outward movement of panels 14 under the pressure of the soil fill F is prevented by the column means 16 of the tie-back elements 12. This load on the vertical column means 16 of each tier is transferred back into the soil and the earth's mass through the leg means 18 which, as noted above, are designed of sufficient length and with a configuration to achieve this end. In this way, each tier is self-sustaining.

The present invention enables the area of a mountain terrain on which on embankment is to be constructed to be minimized. Thus, fill slopes may be constructed within a relatively small area close to a roadway shoulder instead of distributing fill over a large area of mountain terrain with an extended length slope. In conventional fill slope practice about 2 feet of horizontal displacement is normally required for each foot of vertical rise. Along the down side of a mountain slope or hillside this horizontal displacement can become indeterminate. The present invention overcomes this problem and also decreases the horizontal displacement required to as low as one-half foot for each foot or rise with the staggered tier arrangement of FIG. 1. Therefore, the overall angle of inclination of a slope formed by an imaginary line through a mean point in each tier of the present invention can be substantially steeper than what would otherwise be available. Also, wash and other related problems known in the art are substantially reduced or eliminated by the present invention.

In the series of tiers in FIG. 9, the tie back elements 50, 52 of the successive tiers are arranged vertically, one above another, in the same vertical plane and offset inwardly toward the slope. The weight of the tie-back elements above each other in this fashion helps to increase the holding capacity so a steeper slope than one-half foot for each foot of rise of the staggered arrangement of FIG. 1 is practicable.

Individual retaining walls need not follow a straight line horizontally but can be erected along a curvilinear path to follow natural terrain or curves in road embankments. In FIG. 10, individual walls 60, 62 are shown in plan view following a curvilinear path.

Another advantage of the invention is that it lends itself to construction of a retaining wall at differing levels, e.g., to establish a roadside embankment along a road which is rising in elevation. The modular components can be erected to follow such rise. This is shown in FIG. 11 wherein the modular constructed wall portions 70, 72 and 74 are at differing levels following the rise. While each wall portion is a single tier as shown in FIG. 11, it is understood that multiple tiers can be erected as described earlier.

Strengthened precast concrete structures are practical and economical for most applications of the invention, however, the modular elements could be constructed from other suitable materials such as steel, plastic reinforced fiberglas, etc.

In the light of the present teachings, various wall shapes and configurations can be devised without departing from the principles of the present invention.

Therefore, in determining the scope of the invention reference shall be had to the accompanying claims.

What is claimed is:

1. A tie-back element, for modular assembly of a wall for retaining soil along an embankment, such element to be used in combination with and in spaced relationship from other similar elements, with soil retaining panel means extending between each pair of such elements, comprising an elongated, rigid, vertically oriented column means having upper and lower longitudinal ends, an elongated, rigid, horizontally extending leg means projecting in angled relationship to such column means from the lower longitudinal end of such column means, such leg means including horizontally oriented flange means, and web means extending between the column means and the leg means within the interior angle formed by such column means and leg means, such column means, leg means, and web means being unitary and sharing a common vertical plane when the element is in normal upright position for use in a retaining wall, such column means including means extending along a major portion of its length for receiving an end of a soil retaining panel means, such elongated leg means having an overall length which is greater than the height of such column means and including a terminal end longitudinally spaced from that end of the leg means contiguous to the column means, with cross-sectional dimensional characteristics of such leg means being greater at locations contiguous to the terminal end than corresponding dimensional characteristics of portions of such leg means contiguous to such column means, such web means extending along the leg means toward such terminal end.

2. The tie-back element of claim 1 in which the column means and leg means are in substantially right angled relationship forming an L-shaped configuration in side elevation when in such upright position.

3. The tie-back element of claim 1 in which the horizontally oriented flange means is of non-uniform width as measured in a horizontal plane, with such width dimension being greater at the terminal end than at the end joined to the column means.

4. The tie-back element of claim 1 wherein such web means extending along the leg means has at least one means for receiving an implement for handling the element during placement.

5. Structure for a modular assembly for retaining soil along an embankment, comprising in combination at least a pair of laterally spaced tie-back elements, each tie-back element including an elongated, rigid, vertically oriented column means having upper and lower longitudinal ends, an elongated, rigid, horizontally extending leg means projecting in angled relationship to such column means from the lower longitudinal end of such column means, such leg means including horizontally oriented flange means, and web means extending between the column means and the leg means within the interior angle formed by such column means and leg means, such column means, leg means, and web means being unitary and sharing a common vertical plane when the element is in normal upright position for use in a retaining wall, such column means including panel receiving means extending along a major portion of its length, such elongated leg means having an overall length which is greater than the height of such column means and including a terminal end longitudinally spaced from that end of the leg means contiguous to the column means, with a cross-sectional dimension of such leg means being greater contiguous to the terminal end than the corresponding dimension at portions of such leg means contiguous to such column means, the web means extending along the leg means toward such terminal end, and elongated retaining panel means spanning such lateral space between such pair of tie-back elements, such elongated panel means being longitudinally continuous, such retaining panel means having longitudinal ends contacting the panel receiving means along the column means of the tie-back elements and having a concavo-convex configuration in horizontal cross section including opposite concave and convex surfaces with the convex surface facing and receiving soil fill supported by the assembly, such panel receiving means on each column means being in confronting relationship across such lateral spacing between the pair of tie-back elements, the soil retaining panel means and tie-back elements being free of any positive interconnection, with the soil retaining panel means being held in place by their own weight and configuration prior to soil fill against the convex surface of such panel means, the tie-back elements holding such retaining panel means against horizontal outward movement in a direction away from the embankment with soil pressure on such retaining panel means being transmitted back to embankment overburden through such leg means.

6. The assembly of claim 5 in which such soil retaining panel means comprise a plurality of elongated panels stacked in self-supporting relationship free of positive connection means between the panels, one on top another along such elongated column means.

7. The assembly of claim 5 in which th panel receiving means comprise recess means having a rounded cross-sectional configuration with opposite longitudinal ends of such soil retaining panel means having a rounded cross-sectional configuration which conforms to that of such recess means, and further including expansion joint means comprising elastomeric material extending in the recess means of such column means in contact with longitudinal ends of such retaining panel means.

8. The assembly of claim 5 including a plurality of tie-back elements in excess of two arranged in laterally spaced relationship along a substantially horizontal plane with confronting recess means of each pair of tie-back elements receiving retaining panel means and wherein the length of such leg means of the tie-back elements is at least twice the height of such column means.

9. A modular retaining wall system for retaining soil along an embankment, the system comprising a plurality of individual selected-height retaining wall tiers arranged one above the other and offset inwardly toward the embankment with respect to each other for holding an embankment of compacted soil and similar fill material, each of the plurality of such tiers being assembled from modular structures comprising tie-back elements in laterally spaced relationship with elongated soil retaining panel means spanning such space between pairs of tie-back elements, the tie-back elements comprising an elongated, rigid, vertically oriented column means having upper and lower longitudinal ends, an elongated, rigid, horizontally extended leg means projecting in angled relationship to such column means from the lower longitudinal end of such column means, such leg means including horizontally oriented flange means, and web means extending between the column means and the leg means within the interior angle formed by such column means and leg means, such column means, leg means, and web means being unitary and sharing a common vertical plane when the element is in normal upright position, the elongated soil retaining panel means comprising longitudinally continuous panels of concavo-convex configuration in horizontal cross section having concave and convex wall surfaces having opposite longitudinal ends contacting the column means of a spaced pair of tie-back elements with intermediate convex wall surface area confronting the embankment for holding back soil fill, a lower tier of such modular elements being assembled along a substantially horizontal plane, and with a subsequent overlaying tier being assembled independently of the lower tier on fill behind the retaining panel means and above the horizontally extending leg means of the lower tier, such subsequent tier being offset in the direction of the embankment from the lower tier.

10. The assembly of claim 9 in which the laterally spaced tie-back elements of such overlaying tier are located intermediate the lateral spacing between pairs of tie-back elements of the lower tier.

11. A method of erecting a retaining wall for retaining soil along an embankment comprising the steps of forming a substantially horizontal foundation site, providing a plurality of module structures including tie-back means and retaining panel means, the tie-back means comprising a plurality of tie-back elements, each tie-back element comprising an elongated, rigid, vertically oriented column means having upper and lower longitudinal ends, an elongated, rigid, horizontally extending leg means projecting in angled relationship to such column means from the lower longitudinal end of such column means, such leg means including horizontally oriented flange means, and reinforcing web means extending between such column means and leg means within the interior angle formed by such column means and leg means, such column means, leg means, and web means being unitary and sharing a common vertical plane when the element is in normal upright position, the retaining panel means comprising elongated panels being longitudinally continuous and having a concavo-convex configuration in horizontal cross-section with concave and convex wall surfaces, arranging a plurality of tie-back elements in laterally spaced relationship along the horizontal foundation site with their column means in an upright position and their leg means projecting inwardly toward the embankment, positioning an elongated retaining panel to span the lateral space between each pair of cooperating tie-back elements, with longitudinal ends of the panel means contacting the column means of the tie-back elements but being free of positive interconnection with such tie-back elements, and providing a fill behind such panel means in the direction of the embankment, such soil fill contacting convex wall surfaces of such panel means and overlaying the leg means of the tie-back elements.

12. The method of claim 11 wherein a plurality of pairs of tie-back elements are positioned in spaced relationship to establish a longitudinally extending first tier retaining wall.

13. The method of claim 12 including assembling a second tier of modular structures over and above such first tier after overburden has been compacted against the retaining panel means and over horizontal leg means of the tie-back elements of the first tier, the tie-back elements of such second tier being offset inwardly toward the embankment with respect to such first tier, the second tier being assembled independently of the first tier but being assembled in the same fashion as such first tier free of positive interconnection means between tie-back elements and panel means.

* * * * *